US007274899B2

(12) United States Patent
Tomoe

(10) Patent No.: US 7,274,899 B2
(45) Date of Patent: Sep. 25, 2007

(54) IMAGE FORMING DEVICE

(75) Inventor: Tetsuro Tomoe, Osaka (JP)

(73) Assignee: Kyocera Mita Corporation, Osaka (JP)

( * ) Notice: Subject to any disclaimer, the term of this patent is extended or adjusted under 35 U.S.C. 154(b) by 190 days.

(21) Appl. No.: 11/163,776

(22) Filed: Oct. 31, 2005

(65) Prior Publication Data

US 2006/0093402 A1 May 4, 2006

(30) Foreign Application Priority Data

Oct. 29, 2004 (JP) ..... 2004-316785

(51) Int. Cl.
*G03G 15/01* (2006.01)
*G05G 15/08* (2006.01)

(52) U.S. Cl. ..... 399/227; 399/258

(58) Field of Classification Search ..... 399/227, 399/258, 36
See application file for complete search history.

(56) References Cited

U.S. PATENT DOCUMENTS 5,585,598 A * 12/1996 Kasahara et al. ..... 399/227
5,742,319 A * 4/1998 Fukunaga et al.

FOREIGN PATENT DOCUMENTS

JP H10/198149 A 7/1998
JP 2001/134045 A 5/2001
JP 2004/45960 A 2/2004

* cited by examiner

*Primary Examiner*—Susan Lee
(74) *Attorney, Agent, or Firm*—Global IP Counselors, LLP

(57) ABSTRACT

An image forming device is disclosed which is provided with a simple lock mechanism for locking the position of the developing units on a rotary frame during toner supply. In the lock mechanism, a solenoid is turned off and a rod is moved downward by a spring so that a second member is rotated counterclockwise and a claw at the end thereof is engaged with a protruding portion of a first member. In this state, a rotary frame driving gear is prohibited from rotating, i.e., the rotary frame is locked. Thus, it is unnecessary to prepare a conventional two-way lock mechanism, and displacement of the rotary frame during toner supply is restrained with a simple structure.

4 Claims, 9 Drawing Sheets

IMAGE FORMING DEVICE

BACKGROUND OF THE INVENTION

1. Field of the Invention

The present invention relates to an image forming device, and more particularly to an image forming device including a rotary developing device having a plurality of developing units and a rotary frame that maintains the developing units in a circumferential direction in order to place each of the developing units opposite the image bearing member by means of rotation.

2. Background Information

An image forming device utilizing an electrophotographic system includes a photosensitive drum as an image bearing member and other devices located circumferentially around the drum, such as a charger, an exposure device, a developing device, a transfer device, a cleaning device, and so on. In addition, a fixing device is provided downstream of the photosensitive drum in a direction in which the transfer media are conveyed. In this image forming device, first, a surface of the photosensitive drum is uniformly charged by the charger. Then, the photosensitive drum is exposed by the exposure device in accordance with image data so that an electrostatic latent image is formed on the photosensitive drum. The electrostatic latent image is developed by the developing device. In the case of a full color image forming device, four developing units are provided for storing cyan developer, magenta developer, yellow developer, and black developer. The developing units develop the latent image to a toner image with four colors (cyan, magenta, yellow, and black). After that, the toner image is transferred to a transfer medium by the transfer device and then fixed to the transfer media by the fixing device, and the transfer media is finally discharged to a discharge unit. Residual developer remaining on the photosensitive drum is cleaned by the cleaning device.

In the above-mentioned image forming operation, the toner in the toner container is consumed as the development is carried out, and thus it is necessary to refill the toner. There are two systems to compensate for the toner consumed by the image forming operation.

The first system is to fill a certain amount of the toner in the developing unit and replace the developing units when the toner is completely consumed, as shown in Japanese Unexamined Patent Publication No. 2004-45960. In this system, the developing unit and the toner container are formed into a cartridge, so that it is not necessary to supply the toner to the developing unit. Consequently, it is easy to maintain the developing unit.

The second system is to provide a toner container outside of the developing unit so as to supply the toner to the developing unit from the outside, as shown in Japanese Unexamined Patent Publication Nos. 2001-134045 and 10-198149. Recently, as full color image forming devices have been increasingly used by individuals, there have been demands to reduce the size of the image forming device. It is necessary to reduce the size of the developing units in order to reduce the size of the image forming device. In the second system, by providing the toner container outside of the developing unit, the developing unit will be reduced in size.

In the device shown in Japanese Unexamined Patent Publication No. 2004-45960 in which the developing unit and the toner container are formed into a cartridge, it is necessary to place enough toner for about 4,000 sheets of printing in the developing unit in advance, because the toner is not supplied to the developing unit from the outside. As a result, it is difficult to reduce the developing unit in size. Although it is possible to set a toner printing capability to 4,000 sheets or less in order to reduce the size of the developing unit, in that case the cost per one sheet increases. In addition, when the toner is completely consumed, it is necessary to replace the developing units each time. As a result, it increases the burden on the environment.

On the contrary, in a system in which the toner container is provided outside of the developing unit and the toner is supplied to the developing unit from the outside, it is necessary to prepare a member for supplying the toner from the toner container to the developing unit. For example, a plurality of toner supply paths are provided for supplying the toner to each of the developing units in the device shown in Japanese Unexamined Patent Publication No. 2001-134045, and a plurality of toner supply pipes are provided for supplying the toner to each of the developing units in the device shown in Japanese Unexamined Patent Publication No. 10-198149. The toner is supplied to the developing units through the toner supply paths or the toner supply pipes from the toner container.

In a rotary developing device having a plurality of developing units and a rotary frame holding the developing units in a circumferential direction in order to place each of the developing units opposite the image bearing member by means of rotation, it is necessary to advance the toner supply pipe into the developing device in order to supply the toner, and pull the toner supply pipe out from the developing device after the toner supply is finished. Furthermore, in order to stop rotation of the rotary frame when the toner supply pipe is inserted into and pulled out from the developing device, a lock mechanism is provided. The lock mechanism is typically adapted to prohibit rotations both clockwise and counterclockwise. As a result, the lock mechanism generally has a difficult structure.

It is an object of the present invention to provide a simple lock mechanism for locking the position of the developing units during the toner supplying operation in the device which includes a toner container apart from the developing device and a toner supply member for supplying the toner to the developing units.

SUMMARY OF THE INVENTION

An image forming device according to a first aspect of the present invention comprises an image bearing member having a surface on which an electrostatic latent image is formed, a laser unit for irradiating the surface of the image bearing member with a laser light in accordance with image data, a developing device for developing the electrostatic latent image on the surface of the image bearing member, a transfer unit for transferring a developed toner image onto a sheet (a transfer medium), a fixing device for fixing the developed image on the sheet, a toner container for storing toner to be supplied to the developing device, and a toner supply member located so as to be movable between a supply position for supplying the developing device with the toner in the toner container and a retracted position apart from the developing device. The developing device includes a plurality of developing units, a rotary frame and a lock mechanism. The developing units are provided to correspond to different developing colors. The rotary frame maintains the developing units in a circumferential direction in order to place each of the developing units opposite the image bearing member by means of rotation. The toner supply member includes a supply member for supplying the toner from the toner container to each of the developing units. The supply member is movable between a supply position wherein a tip of the supply member is advanced into each of the developing units and a retracted position wherein the tip of the supply member is retracted outside of each of the developing units. The lock mechanism prohibits the rotary frame from rotating.

Conventionally, when the toner supply member is inserted into or pulled out of the developing unit, it is necessary to operate a lock mechanism for locking the rotary frame of the developing device both clockwise and counterclockwise. In the device according to the present invention, the rotary frame is adapted to receive torque in the first direction when the toner supply member is inserted into the developing unit, and the lock mechanism is adapted to be capable of prohibiting the rotation of the rotary frame in the first direction, which is the direction of rotation of the rotary frame during the image forming operation. Consequently, in the lock mechanism in the device, the position of the rotary frame is maintained only by prohibiting the rotation of the rotary frame in the first direction. Namely, it is unnecessary to prepare a conventional two-way lock mechanism so that displacement of the rotary frame during the toner supplying operation is restrained with a simple structure.

According to a second aspect of the present invention, in the image forming device according to the first aspect, the developing unit includes a driven member and a driving mechanism having gears for driving the driven member. The rotary frame is supplied with torque in the first direction when the driven member is driven by the driving mechanism.

In the developing device, the developing units are supported by the rotary frame in a circumferential direction, and the rotary frame places each of the developing units opposite the image bearing member by means of rotation for development with each color. Accordingly, the driven member of the developing unit develops a toner image in a position opposing the image bearing member when the rotation of the rotary frame stops.

In this device, when the driven member is driven by the driving mechanism and develops a toner image with a color, the rotary frame is supplied with torque in the first direction. Accordingly, the lock mechanism that prohibits only the rotation of the rotary frame in the first direction can maintain the position of the rotary frame in the developing process, because the rotary frame is supplied with torque in the same direction as with the first rotational direction.

According to a third aspect of the present invention, in the image forming device according to the first or second aspects, the supply member includes a shutter in a toner supply path for prohibiting or allowing toner supply to the developing device.

In the device, when the supply member supplies the toner to the developing device, the shutter provided in the toner supply path is opened, and when the toner supply to the developing device is stopped, the shutter provided in the toner supply path is closed. Accordingly, even if the toner remains in the supply member, toner leakage from the supply member does not occur.

According to a third aspect of the present invention, in the image forming device according to any of the first to third aspects, the developing unit is formed with a toner supply opening, and the toner supply opening of the developing unit is provided with a shutter.

In the device, the shutter is provided at the toner supply opening of the developing unit, and the shutter is opened so as to supply the toner into the developing device. The shutter is closed so as to stop the toner supply. Consequently, the toner does not leak from the toner supply opening of the developing unit into the device.

In the device according to the present invention, the rotary frame is adapted to receive torque in the first direction when the toner supply member is advanced into the developing unit, and the lock mechanism is adapted to be capable of prohibiting the rotation of the rotary frame in the first direction. Consequently, it is only necessary for the lock mechanism to prohibit the rotation of the rotary frame in the first direction. Namely, it is unnecessary to prepare a conventional two-way lock mechanism, so that displacement of the rotary frame during the toner supplying operation is restrained with a simple structure.

These and other objects, features, aspects and advantages of the present invention will become apparent to those skilled in the art from the following detailed description, which, taken in conjunction with the annexed drawings, discloses a preferred embodiment of the present invention.

BRIEF DESCRIPTION OF THE DRAWINGS

Referring now to the attached drawings which form a part of this original disclosure.

DETAILED DESCRIPTION OF THE PREFERRED EMBODIMENTS

Figure 1:
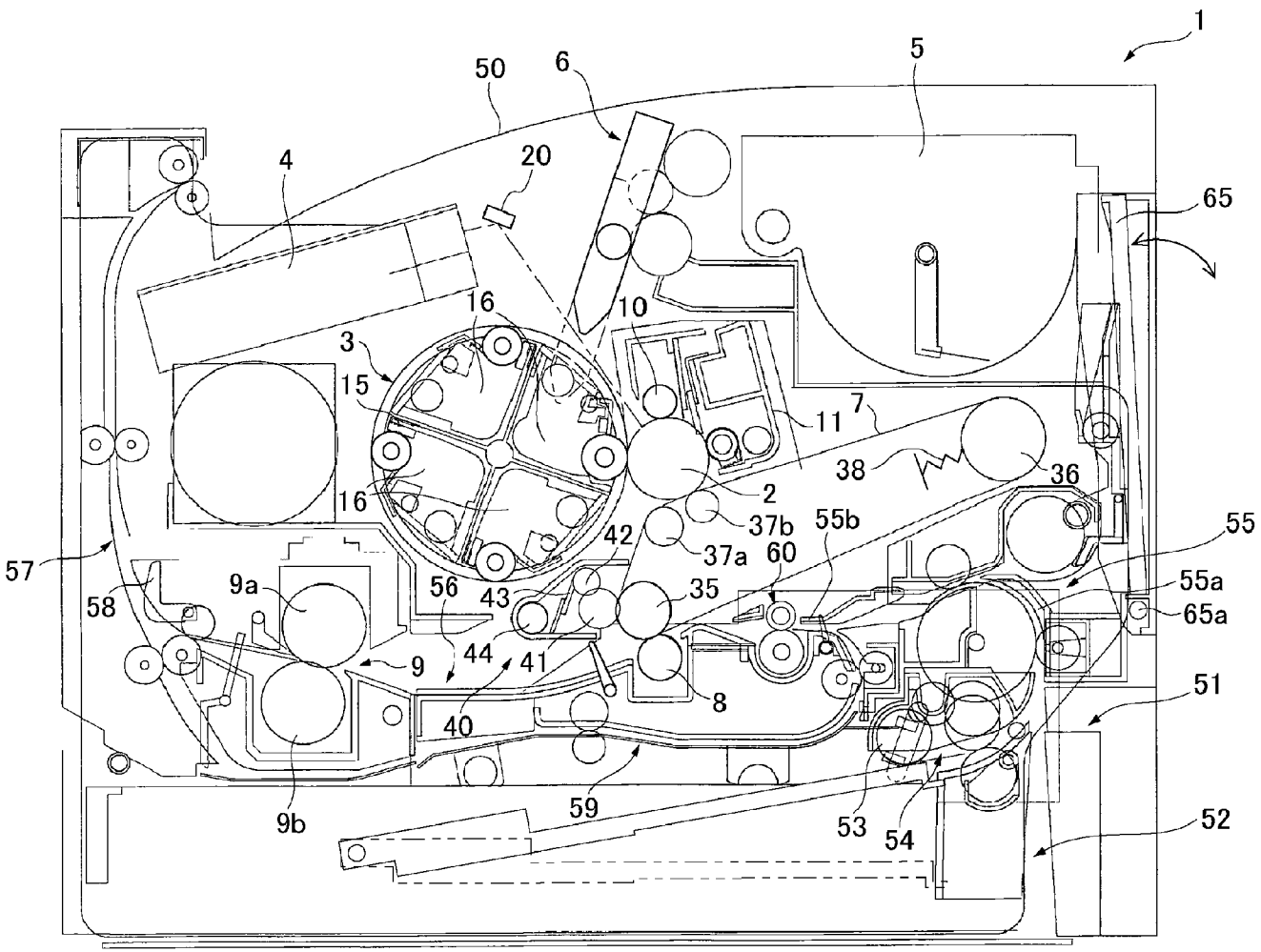
FIG. 1 is a schematic structural view of a color printer according to an embodiment of the present invention.

FIG. 1 shows a color printer 1 as a color image forming device according to one embodiment of the present invention. FIG. 1 is a view showing a frame format of the locations of each component, and thus details of each portion are omitted.

Overall Structure

The color printer 1 is connected to a computer, for example, and is capable of printing a color image on a sheet in accordance with image data sent from the computer. In this color printer 1, the right side of FIG. 1 is the side from which an operator operates the color printer 1. In the below description, the right side in FIG. 1 is referred to as the "front side" and the left side in FIG. 1 is referred to as the "rear side".

The color printer 1 includes a photosensitive drum 2, a rotary developing device 3, a laser unit 4, a toner container 5, a toner supply device 6, an intermediate transfer belt 7, a secondary transfer roller 8, and a fixing device 9.

Photosensitive Drum

The photosensitive drum 2 has a surface on which an electrostatic latent image is formed, and is rotatably mounted substantially in the center of the device. The rotational axis of the photosensitive drum 2 is located such that the axis extends in a lateral direction seen from the front side of the device, i.e., perpendicular to the plane of FIG. 1. On an upper portion of the photosensitive drum 2, a charge roller 10 for uniformly charging a surface of the photosensitive drum 2 is mounted. On a lateral side of the photosensitive drum 2, a drum cleaning device 11 is mounted for cleaning residual toner and other matter on the surface of the photosensitive drum 2.

Rotary Developing Device

The rotary developing device 3 is a device for developing an electrostatic latent image formed on the photosensitive drum 2 with each color toner. The rotary developing device 3 is located adjacent to the photosensitive drum 2, and has a center substantially corresponding to the center of the photosensitive drum 2 in a vertical direction. The rotary developing device 3 includes a rotary frame 15 and four developing units 16 corresponding to four color toners and supported by the rotary frame 15. The rotary frame 15 is a cylindrical member rotatable around an axis in parallel with the rotational axis of the photosensitive drum 2, and is driven by a driving mechanism including a motor 90 and gears shown in FIG. 4.

Figure 2:
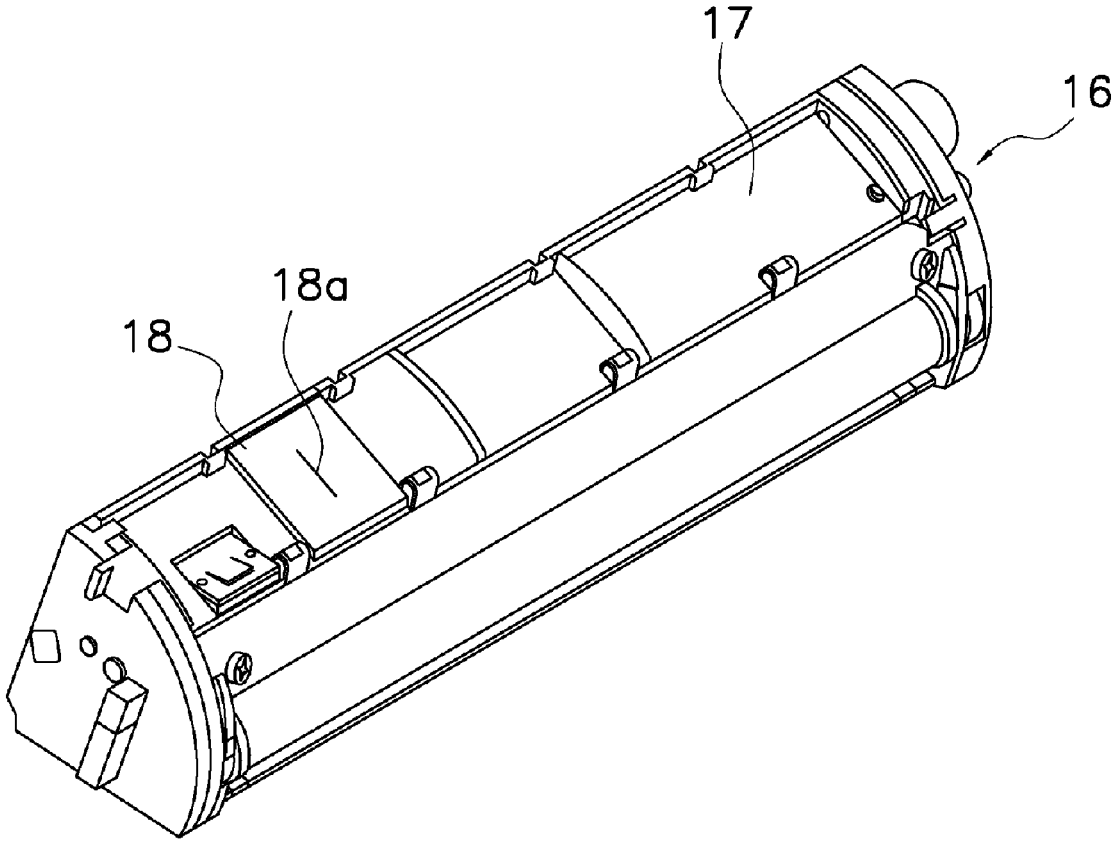
FIG. 2 is an external perspective view of the developing unit.
Figure 3:
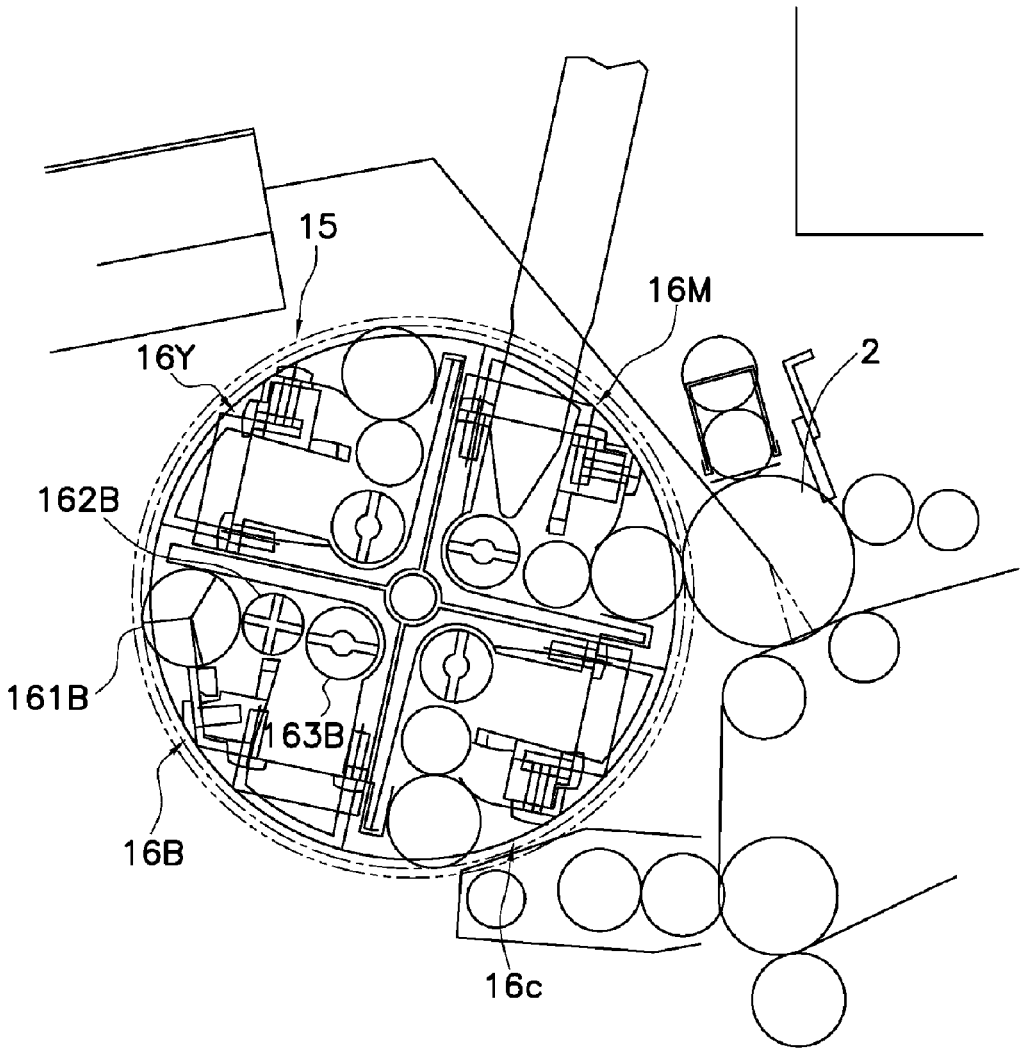
FIG. 3 is a sectional view of the developing unit driving mechanism.

In addition, as shown in FIGS. 1 to 3, the rotary frame 15 is formed with four compartments divided into quarters by partitions extending from the center of the rotational axis radially outward. Each of the compartments accommodates each of the developing units 16 corresponding to four color toners such as yellow, cyan, magenta, and black. Each of the developing units 16 has a common structure, and includes a developing roller 161 capable of being located so as to be opposed to the photosensitive drum 2, a sliding contact roller 162, and an agitation roller 163 for agitating the toner, referring to FIG. 3. On an outer surface of a case 17 of the developing unit 16, a toner supply portion 18 is provided as shown in FIG. 2. The toner supply portion 18 having an elastic member with a slit 18*a* is located at an opening of the case 17.

Figure 4:
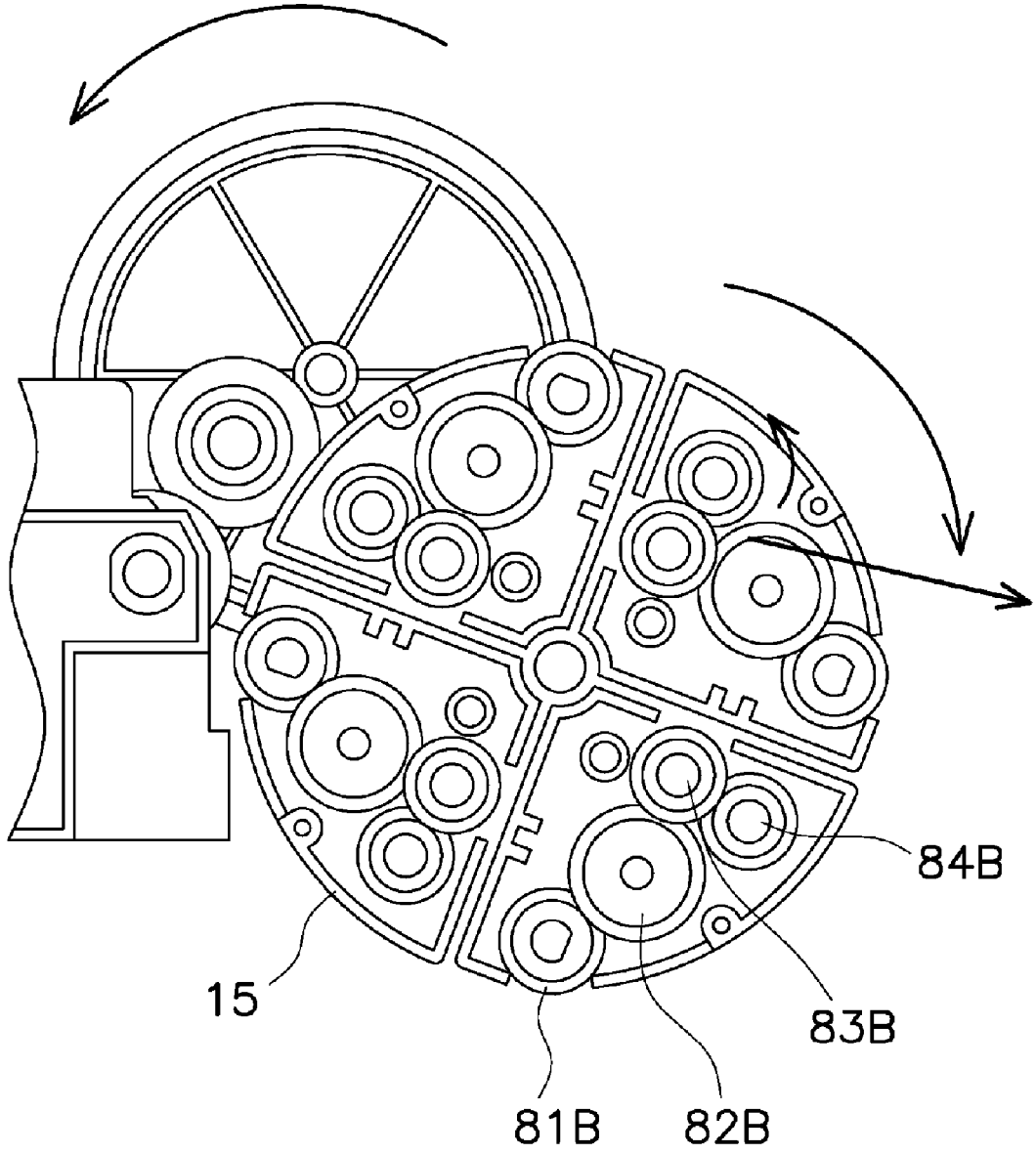
FIG. 4 is a sectional structural view of the developing unit driving mechanism.

Next, a driving mechanism for the developing units will be described, referring to FIG. 4. In the following description, although only the black developing unit 16B will be explained, its basic structures are common with the other color developing units 16Y, 16M, and 16C. The driving mechanism includes a roller driving gear 81B, a paddle driving gear 82B, an intermediate gear 83B, and an input gear 84B. The roller driving gear 81B is fixed to an axial end of the developing roller 161B, and the paddle driving gear 82B is fixed to an axial end of a paddle such that the gears 81B and 82B are engaged with each other.

Next, an external driving mechanism 100 for driving the developing units will be described. The external driving mechanism 100 drives the rotary frame as well.

Figure 5:
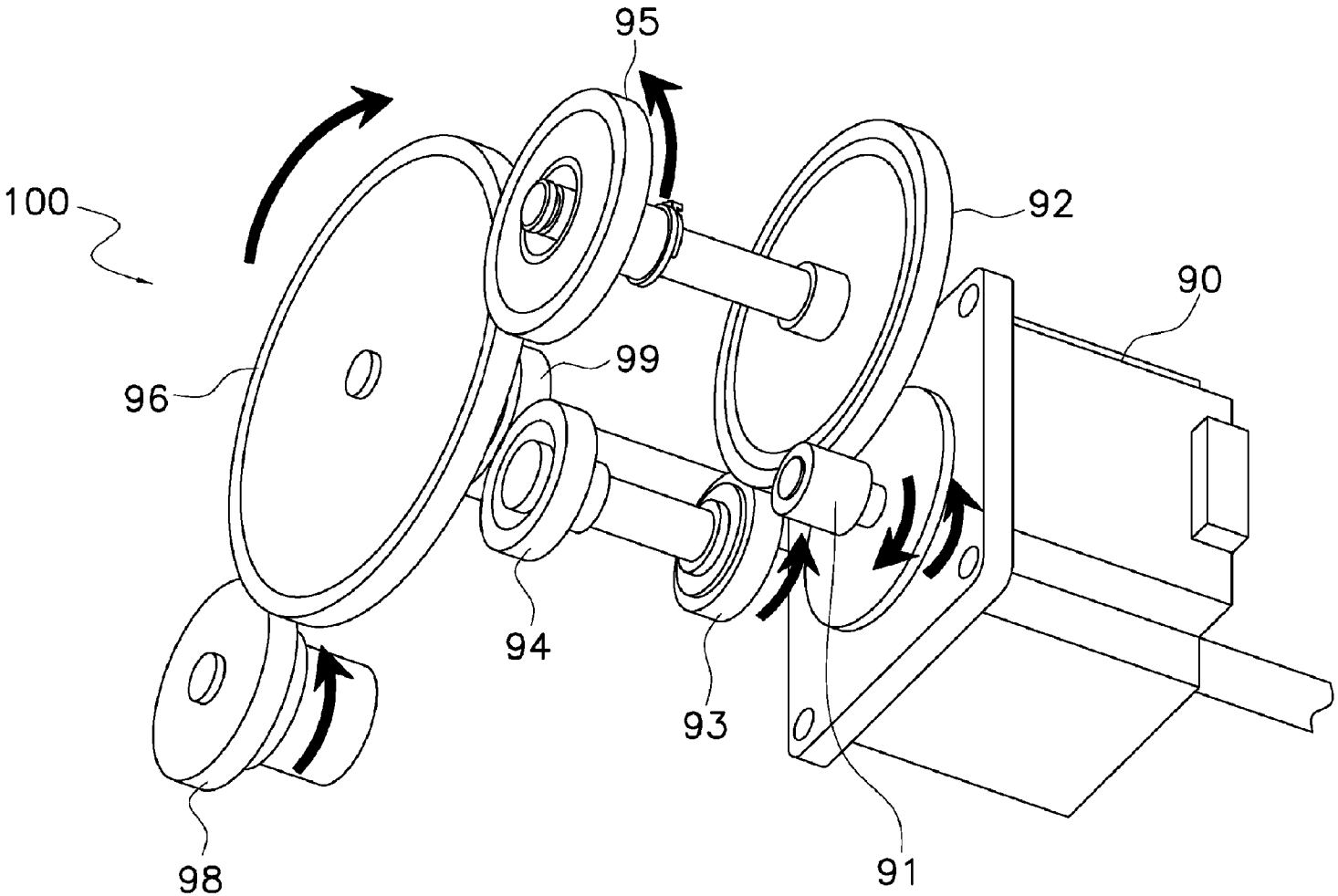
FIG. 5 is a perspective view of the train of the gears of the developing unit driving mechanism.

As shown in FIG. 5, the external driving mechanism 100 includes a motor 90, a train of gears 91 to 96, a developing unit driving gear 98, and a rotary frame driving gear 99. The motor 90 is fixed to a frame of the device. The train of gears includes a first gear 91 fixed to an output shaft of the motor 90, a second gear 92 engaged with the first gear 91, a third gear 93 engaged with the second gear 92, a fourth gear 94 located coaxially with the third gear 93 and rotating in synchronization with the third gear 93, and the rotary frame driving gear 99 engaged with the fourth gear 94. The rotary frame driving gear 99 rotates the rotary frame 15. After the rotary frame 15 is rotated to a predetermined position, the rotational direction of the motor 90 is reversed. The third gear 93 has a built-in one-way clutch inside so that the third gear 93 rotates but the axis does not rotate.

In addition, the train of gears also includes a fifth gear 95 located coaxially with the second gear 92 and rotating in synchronization with the second gear 92, and a sixth gear 96 engaged with both the fifth gear 95 and the developing unit driving gear 98. The developing unit driving gear 98 is engaged with the input gear 84 on the developing unit side. The fifth gear 95 also has a built-in one-way clutch so that the fifth gear 95 does not rotate in the normal rotation of the motor 90, but rotates in the reverse rotation of the motor 90 so as to transmit driving force to the developing unit driving gear 98.

Figure 6:
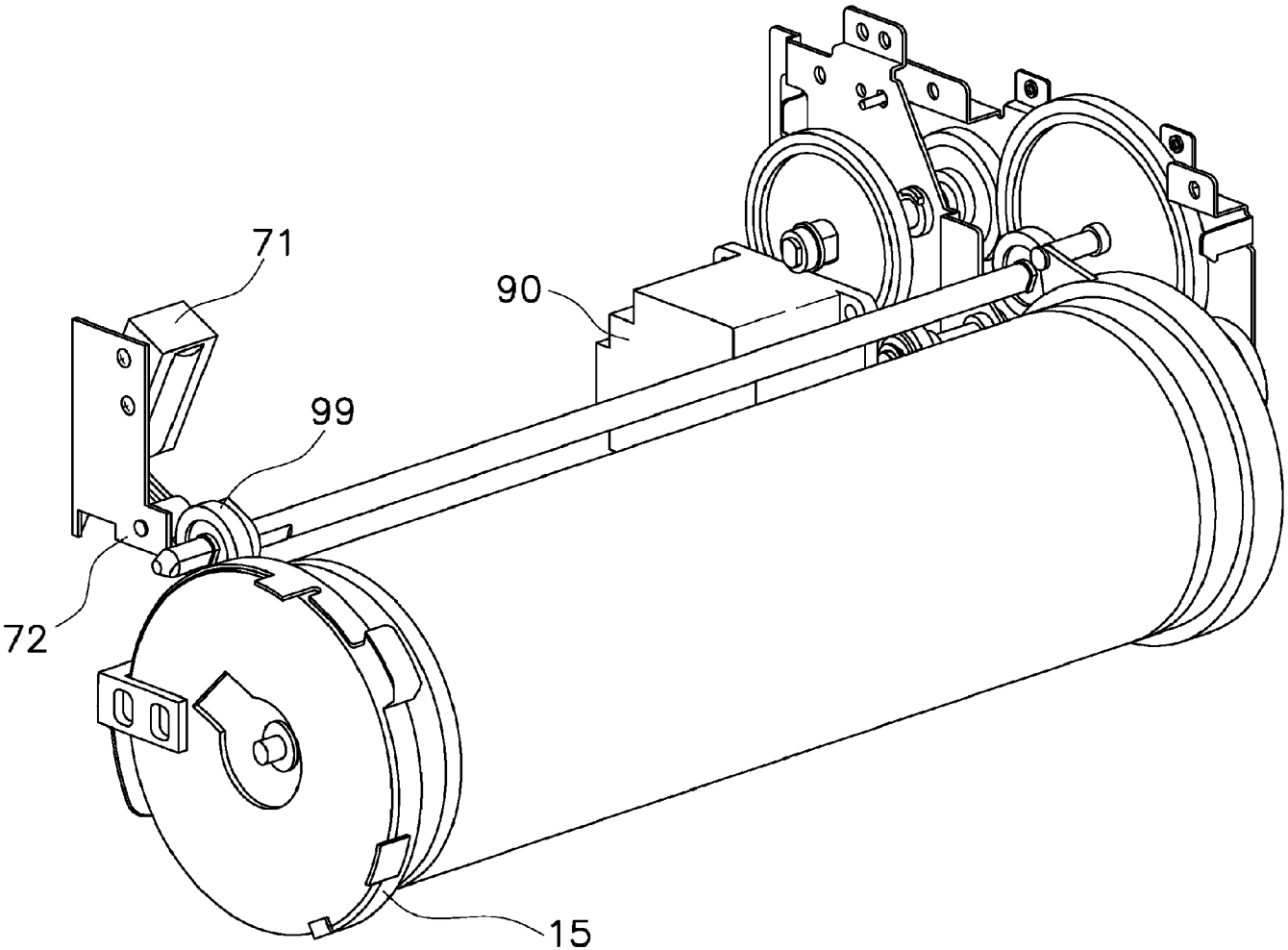
FIG. 6 is a perspective view of the rotary developing device.
Figure 7:
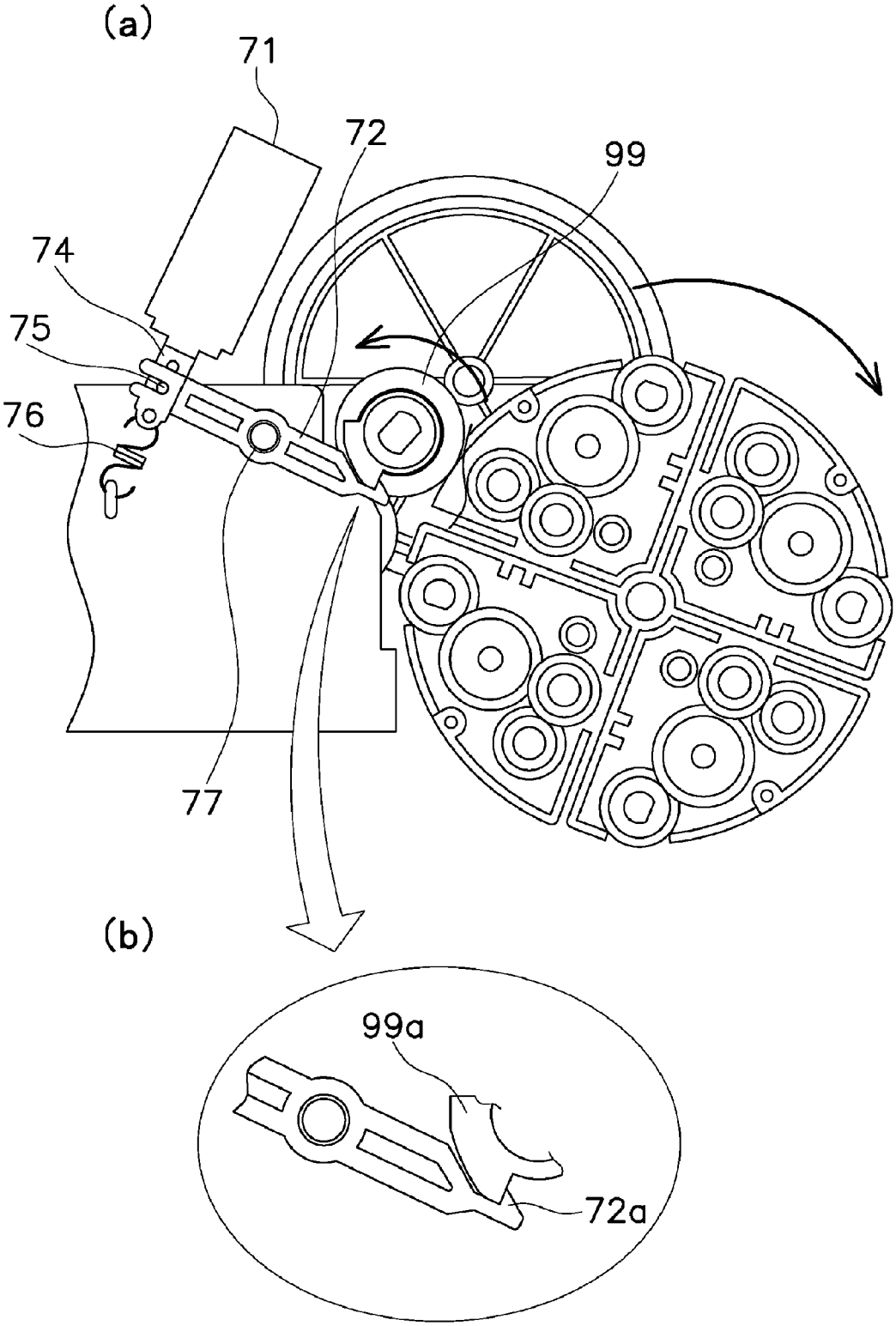
FIG. 7 is a sectional view of the lock mechanism for the developing units.

Next, a lock mechanism for the rotary frame 15 of the developing unit 16 will be described. As shown in FIGS. 6 and 7, torque from the external driving mechanism motor 90 is transmitted though a train of gears to the rotary frame driving gear 99 so as to drive the rotary frame 15. At an axial end of the rotary frame driving gear 99, part of which is enlarged in FIG. 7(*b*), a first lock member 99*a* is provided and has a protruding portion for engagement. The first member 99*a* is non-rotatably fixed to an axial end of the rotary frame driving gear 99. A second lock member 72 is provided below the first member 99*a* and in the opposite direction of the rotary frame 15. The second member 72 extends in one direction and its center is rotatably supported by a fulcrum shaft 77. The second member is formed with a claw 72*a* which can be engaged with the protruding portion of the first member 99*a* at an end, and a groove for driving at a base end. Above the base end of the second member 72, a solenoid 71 is provided. The solenoid 71 includes a rod 74 movable in a vertical direction by means of on/off electricity. The solenoid 71 is adapted such that the rod 74 recedes upward when the electricity is supplied, and is urged downward by a spring 76 located below. A pin 75 fixed to the rod 74 of the solenoid 71 is engaged with the groove at the base end of the second member 72.

According to the above-mentioned structure, when the solenoid 71 is turned on, in FIG. 6, the rod 74 moves upward so that the second member 72 rotates clockwise around the fulcrum shaft 77 and the claw 72*a* at the end departs from the protruding portion of the first member 99*a*. In this state, the rotary frame gear, i.e., the rotary frame is freely rotatable, which means the lock is released. On the contrary, when the solenoid 71 is turned off, the rod 74 is moved downward by the spring 76 so that the second member 72 rotates counterclockwise in reverse and the claw 72*a* at the end is engaged with the protruding portion of the first member 99*a*. In this state, the rotary frame driving gear 99, i.e., the rotary frame 15 is locked in rotation because the claw 72*a* and the protruding portion of the first member 99*a* are engaged.

Laser Unit

The laser unit 4 is a device to scan and expose the photosensitive drum 2 in accordance with image data sent from the external computer, and is located above the photosensitive drum 2 and on the rear side of the rotational axis of the rotary developing device 3. More specifically, the front end of the laser unit 4, the end from which a laser light is emitted, is located immediately above the rotational axis of the rotary developing device 3, and the rear end is located below the upper end of the rotary developing device 3, with the whole of the laser unit 4 slanting downward toward the rear end. The inner construction of the laser unit 4 is common with that of conventional laser units, and includes a laser light source, a polygon mirror, a motor for driving the polygon mirror, and so on. In addition, on the front side of a laser light path from the laser unit 4, a reflective mirror 20 is provided so that the laser light emitted from the laser unit 4 is reflected by the reflective mirror 20, then passes on the front side of and above the rotary developing device 3, and is finally applied to the surface of the photosensitive drum 2 as shown in dotted lines in FIG. 1.

Toner Container

The toner container 5 is a member for storing toner to be supplied to each of the developing units 16 of the rotary developing device 3, and is located above the photosensitive drum 2 and on a side opposite to the laser unit 4 (on the front side of the device). The toner container 5 includes four containers (not illustrated) arranged in a lateral direction, i.e., in a direction perpendicular to the sheet in FIG. 1, for storing color toner such as yellow, cyan, magenta, and black. The toner container 5 can be pulled out toward the front side of the device.

Toner Supply Device

Figure 8:
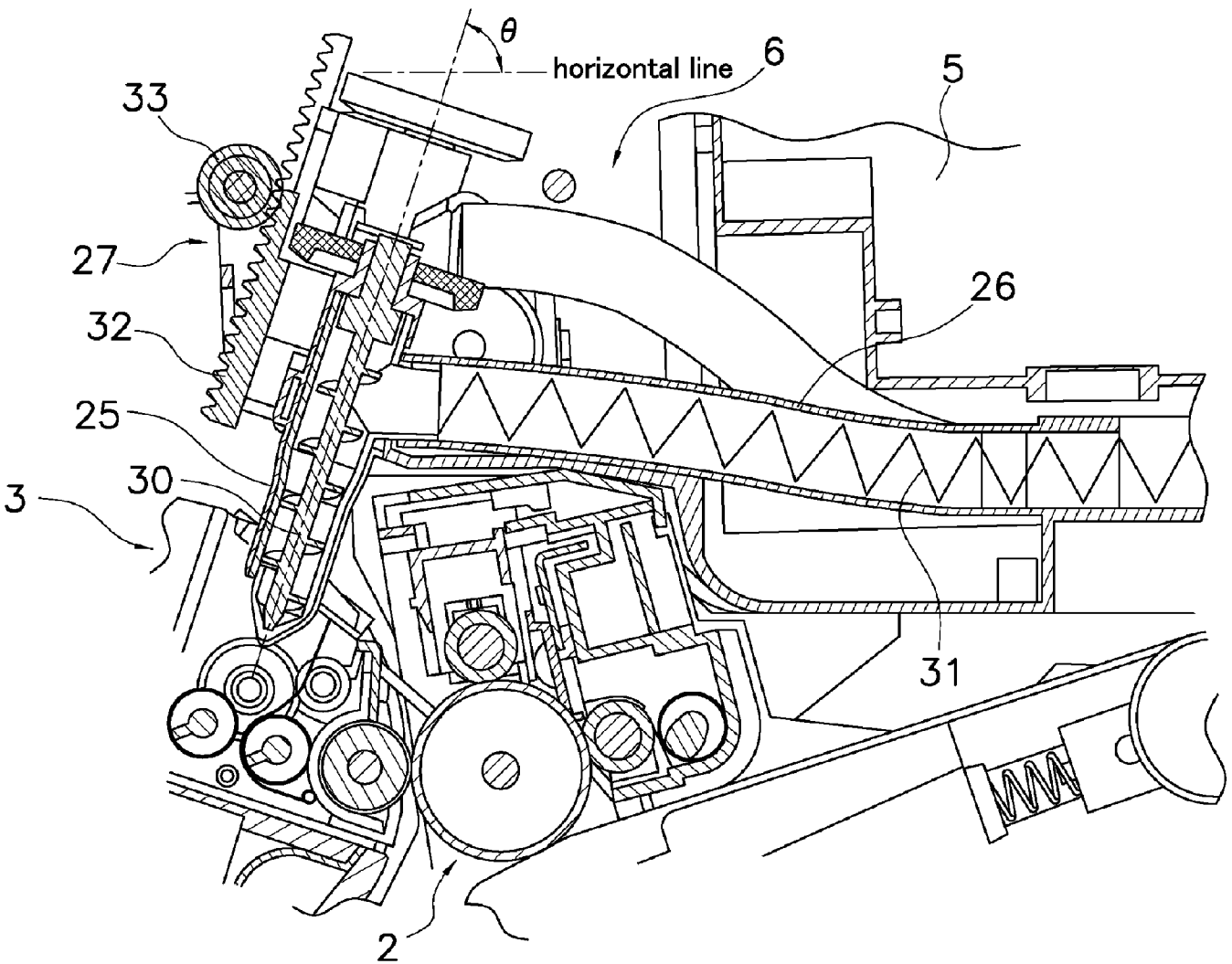
FIG. 8 is a detailed sectional structural view of the toner supply device.

The toner supply device 6 is a device to supply each toner contained in the toner container 5 to the corresponding developing units 16, and is located above the photosensitive drum 2 and in a space between the laser unit 4 and the toner container 5. The toner supply device 6 includes, as shown in FIG. 8, four toner supply pipes 25 that are vertically movable, four conveyance pipes 26 for connecting portions that store each color toner in the toner container 5 with the corresponding toner supply pipes 25, and a drive mechanism 27 for moving the toner supply pipes 25 up and down.

The toner supply pipe 25 extends vertically, and is inclined such that an upper end is on the front side in the device and a lower end is on the rear side in the device. More specifically, as shown in FIG. 8, the toner supply pipe 25 is inclined such that the center axis of the toner supply pipe 25 maintains a repose angle of toner (θ) or more relative to the horizontal line. The toner supply pipe 25 has a tapered tip, which can advance into the inside of the developing unit 16 through the slit 18*a* of the toner supply portion 18 when the toner supply pipe 25 moves downward. Inside of the toner supply pipe 25, a spiral member 30 for conveying the toner is rotatably installed. As shown in FIGS. 1 and 8, the toner supply pipe 25 is located on the right side from the center of the rotary frame 15, so that when the toner pipe 25 is advanced into the toner supply portion 18 of the developing unit 16, a clockwise moment as seen from the front of the figure, i.e., a moment that causes the rotary frame 15 to rotate clockwise as seen from the front of the figure, will be generated.

The conveyance pipe 26 is flexible enough to follow the vertical movements of the toner supply pipe 25. Inside of the conveyance pipe 26, a coil spring 31 is provided for conveying the toner to the toner supply pipe 25 within the conveyance pipe 26 when the coil spring 31 is rotated by a drive mechanism (not illustrated).

The drive mechanism 27 includes racks 32 provided on the outer circumference of the toner supply pipes 25 extending in the axial direction of the pipes 25, and pinion gears 33 engaged with the racks 32. The pinion gears 33 are rotatably supported by a frame of the device and are driven by motors (not illustrated). The drive mechanism 27 makes it possible for the four toner supply pipes 25 to move between a retracted position upward shown in solid lines in FIG. 1, and a supply position downward shown in double-dashed lines in FIG. 1, wherein the tip is inserted into the developing unit 16. As mentioned above, the laser light of the laser unit 4 passes above and on the front side of the rotary developing device 3. Namely, the laser light path and moving paths of the toner supply pipes 25 are crossed with each other although the laser light path is not blocked by the toner supply pipes 25 when the toner supply pipes 25 is positioned in the retracted position, the laser light path is blocked by the toner supply pipe 25 when the toner supply pipe 25 is positioned in the supply position.

Figure 9:
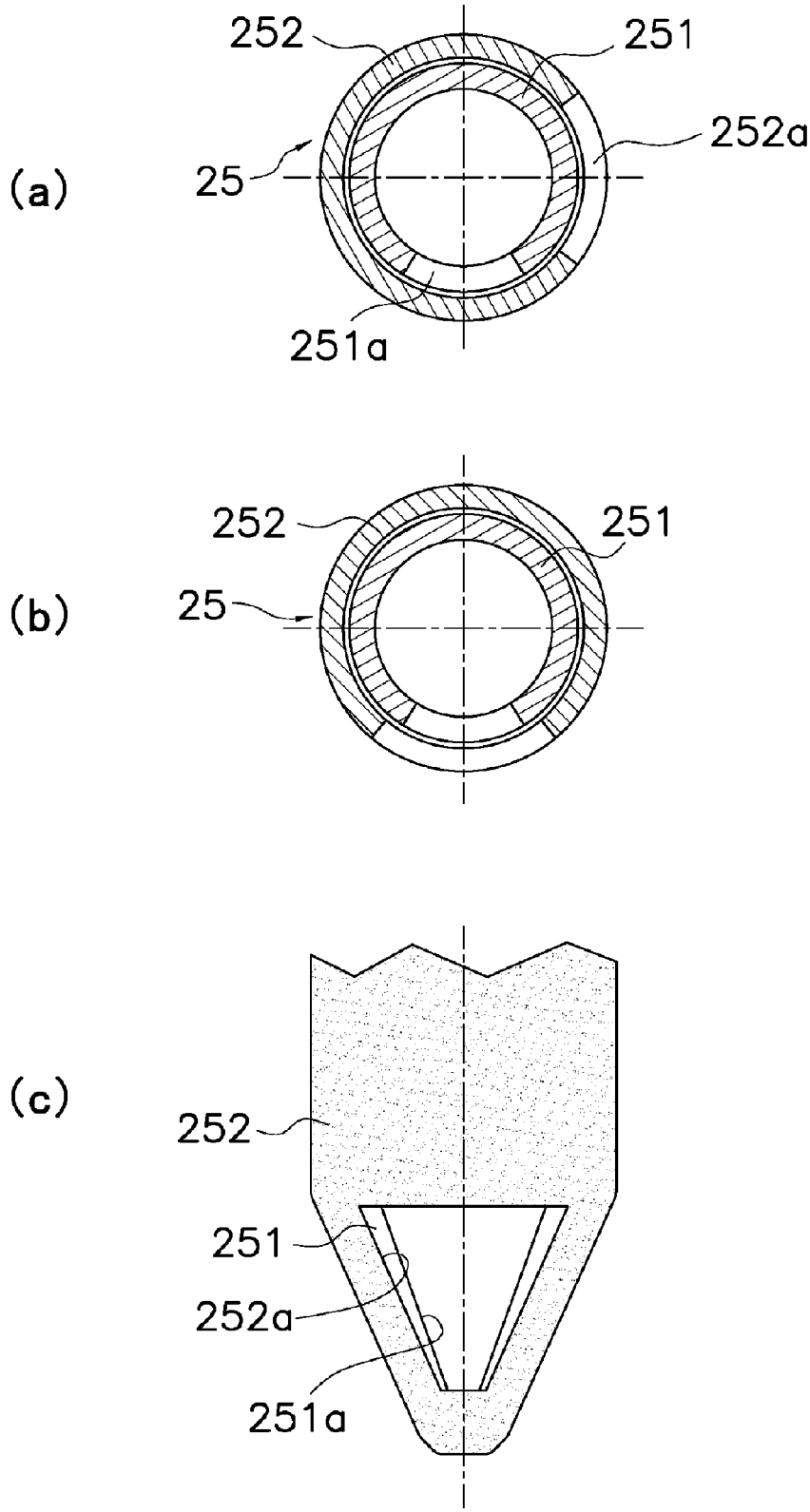
FIG. 9 is a structural view of the tip of the toner supply pipe.

The toner supply pipe 25 has a shutter mechanism which opens only when the toner supply pipe 25 is positioned in the supply position. More specifically, as shown in FIGS. 8 and 9, the toner supply pipe 25 has an overlapped structure of an inner cylinder 251 and an outer cylinder 252, and tips of the cylinders are formed with openings 251*a* and 252*a* having a circumferential length. The opening 252*a* of the outer cylinder 252 has an opening angle larger than the opening 251*a* of the inner cylinder 251. When the toner supply pipe 25 is in the retracted position upward, the opening 251*a* of the inner cylinder 251 and the opening 252*a* of the outer cylinder 252 do not overlap with each other (shutter closed, shown in FIG. 9(*a*)) so that the toner does not leak outside. On the contrary, when the toner supply pipe 25 moves downward, the outer cylinder 252 rotates by a rotation mechanism (not illustrated), the tip of the toner supply pipe 25 is inserted into the developing unit 16. Then, when the toner supply pipe 25 reaches the supply position, the opening 251*a* of the inner cylinder 251 and the opening 252*a* of the outer cylinder 252 overlap with each other (shutter closed, in FIGS. 9(*b*) and (*c*)) so that the inside toner is supplied to the inside of the developing unit 16 from the openings 251*a* and 252*a*.

Intermediate Transfer Belt

The intermediate transfer belt 7 is a member on which the toner images in each color formed on the photosensitive drum 2 are sequentially transferred, and is located below the photosensitive drum 2 and the toner container 5. The intermediate transfer belt 7 is looped over a driving roller 35 and a follower roller 36 located in the opposite directions. A portion of the transfer belt 7 facing the photosensitive drum 2 is constructed so as to be brought into contact with the photosensitive drum 2 by a pair of primary transfer rollers 37*a* and 37*b*.

The arrangement of the above-mentioned components will be described in more detail. The driving roller 35 is located immediately below contact portions of the photosensitive drum 2 and the rotary developing device 3, and the center is positioned below the lower end of the rotary developing device 3. The driving roller 35 is driven by a driving unit including a motor and a gear (not illustrated). The follower roller 36 is located adjacent to a bottom of the toner container 5 and on the front side in the device, and its position in a vertical direction is substantially the same with a position of the photosensitive drum 2. The follower roller 36 is urged by a spring 38 in the direction opposite to the driving roller 35 so that the intermediate transfer belt 7 is tensioned. In addition, the primary transfer rollers 37*a* and 37*b* are located adjacent to each other below the photosensitive drum 2 so that a certain range of the transfer belt 7 is in contact with the photosensitive drum 2.

A belt cleaning device 40 for cleaning the transfer belt 7 is located on the rear side of the driving roller 35 and below the rotary developing device 3. The belt cleaning device 40 includes a fur brush 41 located in a position facing the driving roller 35 and in sliding contact with the surface of the transfer belt 7, a cleaning roller 42 located above the fur brush 41 so as to be in contact with the fur brush 41, a blade 43 having a tip located so as to be in contact with a surface of the cleaning roller 42, and a recovery spiral 44 located below the blade 43 side by side.

In this cleaning device 40, matter attached to the intermediate transfer belt 7 is scraped off by the fur brush 41, and then is recovered to the cleaning roller 42. The matter is then scraped off by the blade 43 from the surface of the cleaning roller 42 and then recovered to a recovery unit (not illustrated) by the recovery spiral 44.

Secondary Transfer Roller

The secondary transfer roller 8 is a member to transfer the image transferred on the intermediate transfer belt 7 onto the conveyed sheet, and is located below the driving roller 35 and facing the driving roller 35. Bias voltage is applied to the secondary transfer roller 8 by an energizing means (not illustrated) so as to transfer the image to the sheet.

Fixing Device

The fixing device 9 is a device to fix the toner image transferred onto the sheet by fusion and is located below the rotary developing device 3 and on the rear side in the device. The fixing device 9 includes a heating roller 9*a* having a built-in heater and a pressure roller 9*b* pressing against the heating roller 9*a* for pinching the sheet therebetween so as to convey the sheet.

Discharge Unit

In the printer 1, the discharge unit 50 is provided on a surface of an upper portion of the device, i.e., above the laser unit 4, the toner supply device 6 and the toner container 5, and sheets on which images have been formed are discharged thereto. The discharge unit 50 consists of a curved portion gradually increasing the height from the lowest portion on the laser unit 4 side (on the rear side in the device) to the other side on the toner container 5 side (on the front side in the device), and a flat portion continuous with the curved portion located above the toner container 5.

Sheet Feeding Unit

At the bottom of the device, the sheet feeding unit 51 for storing the sheets and dispatching the sheets is provided. The sheet feeding unit 51 includes a sheet feeding cassette 52 having a stack plate on which the sheets are stacked, a forward feeding roller 53 and a multiple feeding prevention mechanism 54 for sending individual sheets into the conveyance path. The sheet feeding cassette 52 can be pulled out toward the front side of the device.

Conveyance Mechanism

The conveyance mechanism for conveying sheets is located between the sheet feeding unit 51 and the discharge unit 50. The conveyance mechanism includes a first conveyance path 55 from the sheet feeding unit 51 to the secondary transfer roller 8, a second conveyance path 56 from the secondary transfer roller 8 to the fixing device 9, and a third conveyance path 57 from the fixing device 9 to the discharge unit 50. At an exit of the fixing device 9, a branching claw 58 is provided, and a return conveyance path 59 is provided between the branching claw 58 and a middle of the first conveyance path 55 for returning the sheet to the first conveyance path 55.

The first conveyance path 55 includes a curved path 55*a* for reversing the conveyance direction as well as conveying the sheet sent out from the sheet feeding cassette 52 upward, and a straight path 55*b* extending from the curved path 55*a* to the secondary transfer roller 8. These conveyance paths are composed of guide plates and pairs of rollers for guiding the sheets as well as conveying them, and include sensors installed at places for sensing the sheet. In addition, a pair of registration rollers 60 is provided in the straight path 55*b* for controlling conveyance timing of the sheets.

The second conveyance path 56 extends in a rectilinear direction, is composed of guide plates and pairs of rollers for guiding the sheets as well as conveying them, and includes sensors installed at places for sensing the sheet.

The third conveyance path 57 includes a vertical conveyance path formed downstream of the branching claw 58 in the conveyance direction. Namely, the sheet is conveyed upward in the vertical direction after passing the branching claw 58 and is discharged to the discharge unit 50. The third conveyance path 57 is also composed of guide plates and pairs of rollers for guiding the sheets as well as conveying them.

The return conveyance path 59 is a conveyance path which branches off downward from the third conveyance path 57 at a place where the branching claw 58 is mounted and extends below the fixing device 9, the second conveyance path 56, the secondary transfer roller 8 and the pair of the registration rollers 60, and then extends upward so as to join upstream of the pair of the registration rollers 60 in the first conveyance path 55 in the conveyance direction. Namely, the return conveyance path 59 is a conveyance path located vertically between the sheet feeding cassette 52 and straight path 55*b* of the first conveyance path 55 as well as the second conveyance path 56. The path 59 returns the sheet passed through the fixing device 9 upstream of the pair of the registration rollers 60, which is located upstream of the secondary transfer roller 8. The return conveyance path 59 is also composed of guide plates and pairs of rollers for guiding the sheets as well as conveying them and includes sensors installed at places for sensing the sheet.

Sheet Feeding Tray

Below the toner container 5 and above the sheet feeding cassette 52, the sheet feeding tray 65 is provided so as to form a lateral wall on the front side of the device. The sheet feeding tray 65 has a lower end pivotably supported in the vicinity of the curved path 55*a* of the first conveyance path 55 such that the sheet feeding tray 65 can take an open position and a closed position. The upper end of the sheet feeding tray 65 can be reclined toward the front side of the device around a rotation center 65*a* in the lower end. Accordingly, when the sheet feeding tray 65 is opened, it is possible to put the sheets on the sheet feeding tray 65 and supply the curved path 55*a* of the first conveyance path 55 with the sheets.

Image Forming Operation

Next, the image forming operation will be explained in a simplified manner. First, when the power is applied to the color printer 1, a variety of parameters are initialized and initialization is executed such as setting a temperature of the fixing device. Then, when the image data from the computer connected to this printer is inputted and an instruction to start printing is given, the image forming operation is carried out as following. It should be noted that during the image forming operation, the toner supply pipe 25 is moved to the retracted position upward so that the laser path is not blocked by the toner supply pipe 25.

First, the charge roller 10 charges the photosensitive drum 2. After that, the photosensitive drum 2 is scanned and exposed by the laser unit 4 in accordance with the image data so that the electrostatic latent image is formed on the photosensitive drum 2. Next, the rotary developing device 3 is rotated and the developing unit 16 whose color is designated is opposed to the photosensitive drum 2. The solenoid 71 is turned off and the rod 74 is moved downward by the spring 76 so that the second member 72 is rotated counterclockwise and the claw 72*a* is engaged with the protruding portion of the first member 99*a*. In this state, the rotary frame driving gear 99 is prohibited from rotating so that the rotary frame 15 is locked in rotation because the claw 92*a* and the protruding portion of the first member 99*a* are engaged with each other. In this state, the electrostatic latent image on the photosensitive drum 2 is developed with the designated toner color. After the development is finished, the solenoid 71 is turned on so that the rod 74 moves upward in FIG. 7 so that the second member 72 rotates clockwise around the fulcrum shaft 77 and the claw 72*a* is disengaged with the protruding portion of the first member 99*a*. In this state, the rotary frame driving gear 99 is freely rotatable, i.e., the rotary frame 15 is unlocked. In this way, the rotary frame 15 of the developing device 3 is maintained during the development of each color.

The developed image is transferred to the intermediate transfer belt 7. The above-mentioned operation is sequentially carried out color by color so that the full color image is formed on the intermediate transfer belt 7. It should be noted that residual toner on the photosensitive drum 2 is cleaned by the drum cleaning device 11 and is discarded into a discarded toner container (not illustrated).

In the sheet feeding unit 51, a sheet is taken out from the sheet feeding cassette 52 by the forward feeding roller 53 and multiple feeding prevention mechanism 54, and is conveyed to the pair of the registration rollers 60 through the first conveyance path 55. Then, the sheet is conveyed from the pair of the registration rollers 60 to the intermediate transfer belt 7 with timing of image forming thereon and guided to the secondary transfer roller 8. The secondary transfer roller 8 is in contact with the intermediate transfer belt 7 and the full color image formed on the intermediate transfer belt 7 is transferred to the sheet by transfer bias applied to the secondary transfer roller 8. The sheet is guided to the fixing device 9 through the second conveyance path 56, and the image is fixed to the sheet by heat and pressure in the fixing device 9. In the case of one-side printing, the sheet is guided to the third conveyance path 57 by means of the branching claw 58, and then is discharged to the discharge unit 50.

In the case of double-side printing, after fixation in the fixing device 9, the sheet is guided by the branching claw 58 toward a side of the return conveyance path 59 and is returned to the first conveyance path 55 again. The sheet is temporarily stopped by the pair of the registration rollers 60. The sheet is sent with precise timing toward the secondary transfer roller 8 after the rear side image is formed on the intermediate transfer belt 7 in the same operation mentioned before. After that, the same operation is carried out and the sheet is guided toward the third conveyance path 57 by means of the branching claw 58 and is discharged to the discharge unit 50.

Toner Supply Operation

When the toner is supplied to the developing units 16, the rotary developing device 3 is rotated such that the developing unit 16 to which the toner will be supplied is positioned in the supply position as shown in FIG. 1. In this state, the solenoid 71 is turned off, and the rod 74 is moved downward by the spring 76 so that the second member 72 rotates counterclockwise in reverse, and the claw 72*a* at the end is engaged with the protruding portion of the first member 99*a*. In this state, the claw 72*a* and the protruding portion of the first member 99*a* are engaged so that the rotary frame driving gear 99 is prohibited from rotating and the rotary frame 15 is locked. Accordingly, position of the rotary frame of the developing device is maintained at the time of supplying each color toner.

Next, the toner supply pipe 25 is moved downward to the supply position. More specifically, the motor 33*a* drives the pinion gear 33 with the gears so that the toner supply pipe 25 to which the rack 32 is fixed is moved downward. Meanwhile, the toner is conveyed to the toner supply pipe 25 by rotation of the coil spring 31 in the conveyance pipe 26. The tip of the toner supply pipe 25 advances through the slit 18*a* as a toner supply opening and into the developing unit 16 after the toner is supplied to the toner supply pipe 25 by the conveyance pipe 26. During the downward movement of the toner supply pipe 25, the outer cylinder 252 rotates relative to the inner cylinder 251. Upon the entry of the tip of the toner supply pipe 25 into the developing unit 16, the opening 252*a* of the outer cylinder 252 and the opening 251*a* of the inner cylinder 251 correspond to each other. In other words, the shutter mechanism is opened so that the toner inside of the toner supply pipe 25 is supplied into the developing unit 16. At this time, the toner does not remain in the pipe 25 because the center axis of the toner supply pipe 25 keeps a repose angle of toner or more relative to the horizontal line.

It should be noted that although the toner supply pipe 25 blocks the laser light path from the laser unit 4 to the photosensitive drum 2 when toner supply pipe 25 is positioned in the supply position, it is not a cause for concern because the toner supplying operation by the toner supply pipe 25 and the image forming operation are not carried out simultaneously.

Upon the end of the toner supply, the coil spring 31 in the conveyance pipe 26 stops rotating. On the contrary, the spiral member 30 located in the toner supply pipe 25 continues to rotate until the toner is completely consumed in the toner supply pipe 25. After that, the motor 33*a* is rotated in a reverse direction to rotate the pinion gear 33 in the reverse direction so that the toner supply pipe 25 to which the rack 32 is fixed is moved upward. At this time, the outer cylinder 252 rotates in the reverse direction so that the opening 251*a* of the inner cylinder 251 and the opening 252*a* of the outer cylinder 252 are misaligned to close the opening, i.e., the shutter is closed. In the toner supply portion 18 of the developing unit 16, when the toner supply pipe 25 is pulled out from the slit 18*a*, the slit 18*a* is also closed by its elastic force. Accordingly, the toner does not scatter in the device from the toner supply pipe 25 and the developing unit 16. Upon the toner supply is finished, the solenoid 71 is turned on, in FIG. 7, the rod 74 moves upward so that the second member 72 rotates clockwise around the fulcrum shaft 77 and the claw 72*a* at the end departs from the protruding portion of the first member 99*a*. In this state, the rotary frame driving gear 99 is freely rotatable, i.e., the rotary frame 15 is unlocked.

In this embodiment, the toner supply pipe 25 is located on the right side of the center of the rotary frame so that a moment which rotates the rotary frame 15 clockwise is generated when the toner supply pipe 25 is inserted into the toner supply portion 18 of the developing unit 16. In addition, when the solenoid 71 is turned off, the rod 74 is moved downward by the spring 76 so that the second member 72 is rotated counterclockwise and the claw 72*a* at the end is engaged with the protruding portion of the first member 99*a*. In this state, the rotary frame driving gear 99 is prohibited from rotating by means of the engagement between the claw 72 and the protruding portion of the first member 99*a*, i.e., the rotary frame 15 is locked. Namely, it is unnecessary to prepare a conventional two-way lock mechanism so that displacement of the rotary frame during the toner supplying operation is restrained with a simple structure.

Furthermore, the shutter are provided at the tips of the toner supply pipes 25 and the toner supply slits 18*a* of the developing unit 16 so that the toner does not leak inside the device.

Any terms of degree used herein, such as "substantially", "about" and "approximately", mean a reasonable amount of deviation of the modified term such that the end result is not significantly changed. These terms should be construed as including a deviation of at least ±5% of the modified term if this deviation would not negate the meaning of the word it modifies.

This application claims priority to Japanese Patent Application No. 2004-316785. The entire disclosure of Japanese Patent Application No. 2004-316785 is hereby incorporated herein by reference.

While only selected embodiments have been chosen to illustrate the present invention, it will be apparent to those skilled in the art from this disclosure that various changes and modifications can be made herein without departing from the scope of the invention as defined in the appended claims. Furthermore, the foregoing description of the embodiments according to the present invention are provided for illustration only, and not for the purpose of limiting the invention as defined by the appended claims and their equivalents.

What is claimed is:

1. An image forming device comprising:

a bearing member having a surface on which an electrostatic latent image is formed;

a laser unit that irradiates the surface of the image bearing member with a laser light in accordance with image data;

a developing device that develops the electrostatic latent image on the surface of the image bearing member;

a transfer unit that transfers a developed toner image onto a sheet;

a fixing device for fixing the developed image on the sheet;

a toner container for storing toner to be supplied to the developing device; and a toner supply member located so as to be movable between a supply position that supplies the developing device with the toner in the toner container and a retracted position apart from the developing device;

wherein the developing device includes a plurality of developing units provided to correspond to different developing colors, a rotary frame holding the developing units in a circumferential direction in order to place each of the developing units opposite the image bearing member by rotation, and a lock mechanism for prohibiting the rotary frame from rotating;

the toner supply member includes a supply member for supplying the toner from the toner container to each of the developing units, and the supply member is movable between a supply position in which a tip of the supply member advances into each of the developing units and a retracted position in which the tip of the supply member is retracted outside of each of the developing units;

the supply member is located such that the supply member applies torque to the rotary frame in a first direction when the supply member advances into each of the developing units; and the lock mechanism is capable of prohibiting the rotary frame from rotating in the first direction.

2. An image forming device according to claim 1, wherein the developing unit includes a driven member and a driving mechanism having gears which drive the driven member; and the rotary frame is supplied with torque in the first direction when the driven member is driven by the driving mechanism.

3. An image forming device according to claim 1, wherein the supply member includes a shutter in a toner supply path which prohibits or allows toner supply to the developing device.

4. An image forming device according to claim 1, wherein the developing unit is formed with a toner supply opening, and the toner supply opening of the developing unit is provided with a shutter.

* * * * *